United States Patent [19]

Manecke et al.

[11] 3,995,245

[45] Nov. 30, 1976

[54] THERMOSTAT CONSTRUCTION AND METHOD OF MAKING THE SAME

[75] Inventors: Siegfried E. Manecke; John W. Stearley; James L. Shaw, all of Indiana, Pa.

[73] Assignee: Robertshaw Controls Company, Richmond, Va.

[22] Filed: July 30, 1975

[21] Appl. No.: 600,457

[52] U.S. Cl. ..... 337/380; 337/368

[51] Int. Cl.[2] ..... H01H 37/04; H01H 37/52

[58] Field of Search ..... 337/343, 346, 347, 365, 337/367, 368, 380, 381

[56] References Cited

UNITED STATES PATENTS

| | | | |
|---|---|---|---|
| 2,153,297 | 4/1939 | Butler | 337/343 X |
| 2,273,381 | 2/1942 | Shaw | 337/380 X |
| 2,564,322 | 8/1951 | Brosseau et al. | 337/343 X |
| 3,525,968 | 8/1970 | Hire | 337/367 X |
| 3,771,387 | 11/1973 | Lewis | 337/380 X |
| 3,943,478 | 3/1976 | Place | 337/349 X |

*Primary Examiner*—George Harris
*Attorney, Agent, or Firm*—Candor, Candor & Tassone

[57] ABSTRACT

A thermostat construction having a first contact and a blade-carried second contact supported in a generally cube-like housing and having a bimetal snap disc carried by the housing for controlling movement of the second contact relative to the first contact in response to snapped temperature sensing conditions of the disc together with temperature setting means carried by the housing for selecting the temperature of operation of the disc for moving the second contact out of contact with the first contact whereby the generally cube-like configuration of the housing renders the thermostat construction relatively small and compact.

10 Claims, 7 Drawing Figures

THERMOSTAT CONSTRUCTION AND METHOD OF MAKING THE SAME

This invention relates to an improved thermostat construction and to a method of making the same or the like.

It is well known that thermostat constructions have been provided wherein each has a first contact and a blade-carried second contact supported in a housing means and having a bimetal snap-disc carried by the housing means for controlling movement of the second contact relative to the first contact in response to snapped temperature sensing conditions of the disc together with temperature setting means carried by the housing means for selecting the temperature of operation of the disc for moving the second contact out of contact with the first contact.

For example, see the Manecke, U.S. Pat. No. 3,870,229, and its related co-pending patent application Ser. No. 408,678, filed Oct. 23, 1973, now U.S. Pat. No. 3,885,222 both of which are assigned to the same assignee to whom this application is assigned.

It is a feature of this invention to provide a thermostat construction of the aforementioned type wherein the same has a generally cube-shaped housing means so that all of the thermostat parts are arranged in a compact relationship inside the cube-shaped housing means to provide a thermostat construction that is relatively small in comparison with the prior known thermostat constructions.

Accordingly, one embodiment of this invention provides a thermostat construction having a first contact and a blade-carried second contact supported in a generally cube-like housing means and having a bimetal snap disc carried by the housing means for controlling movement of the second contact relative to the first contact in response to snapped temperature sensing conditions of the disc together with temperature setting means carried by the housing means for selecting the temperature of operation of the disc for moving the second contact out of contact with the first contact whereby the cube-like housing means renders the thermostat construction relatively small and compact.

Accordingly, it is an object of this invention to provide an improved thermostat construction having one or more of the novel features set forth above or hereinafter shown or described.

Another object of this invention is to provide an improved method of making such a thermostat construction of the like.

Other objects, uses and advantages of this invention are apparent from a reading of this description which proceeds with reference to the accompanying drawings forming a part thereof and wherein.

Figure 1:
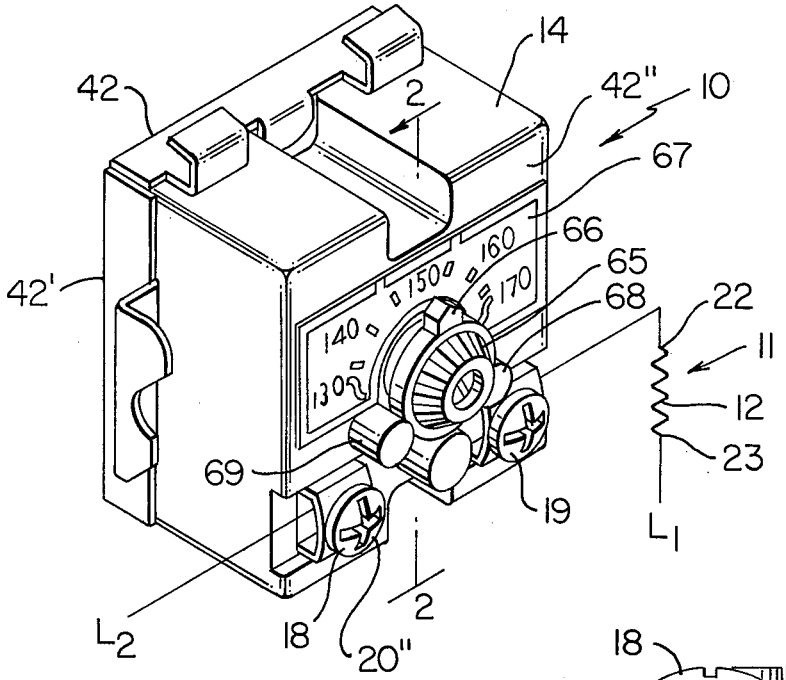
FIG. 1 is a front perspective view of the improved thermostat construction of this invention.
Figure 2:
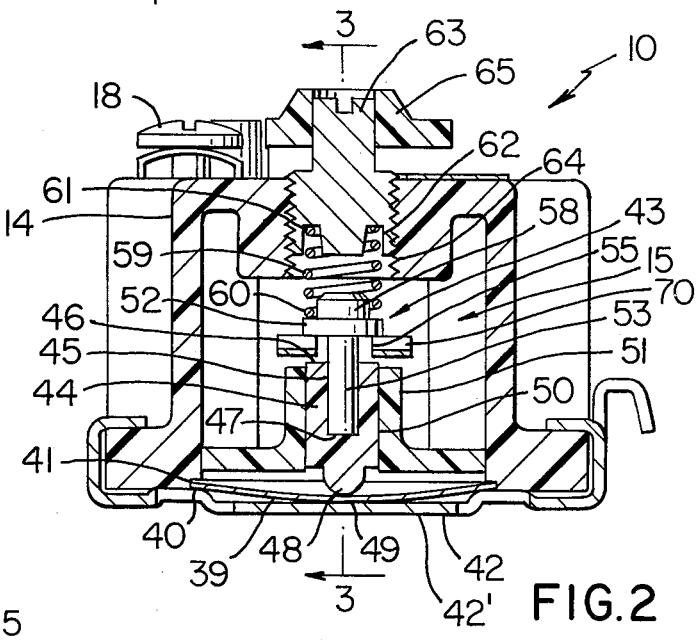
FIG. 2 is a cross-sectional view taken on line 2—2 of FIG. 1.

While the various features of this invention are hereinafter described and illustrated as being particularly adapted to provide a thermostat construction for a water heater or the like, it is to be understood that the various features of this invention can be utilized singly or in any combination thereof to provide a thermostat construction for other uses as desired.

Therefore, this invention is not to be limited to only the embodiment illustrated in the drawings, because the drawings are merely utilized to illustrate one of the wide variety of uses of this invention.

Figure 3:
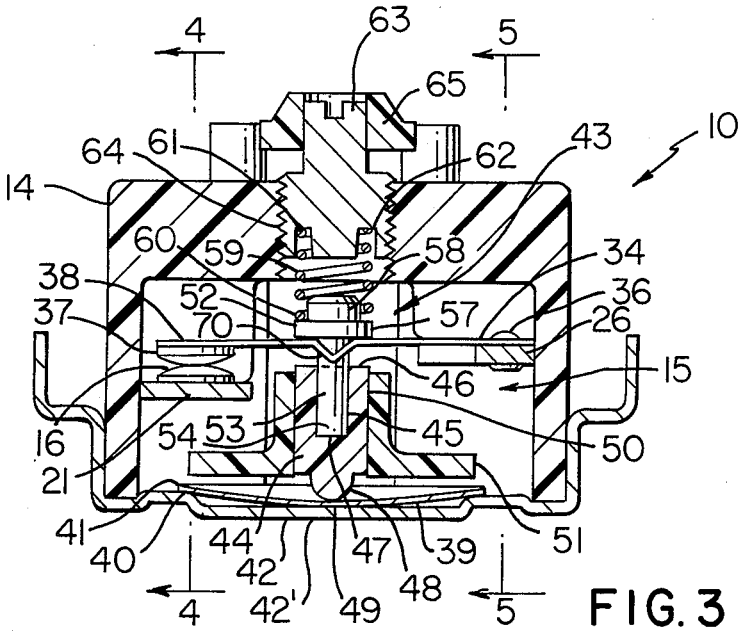
FIG. 3 is a cross-sectional view taken on line 3—3 of FIG. 2 and illustrates the thermostat construction with the contacts thereof in the closed position thereof.
Figure 4:
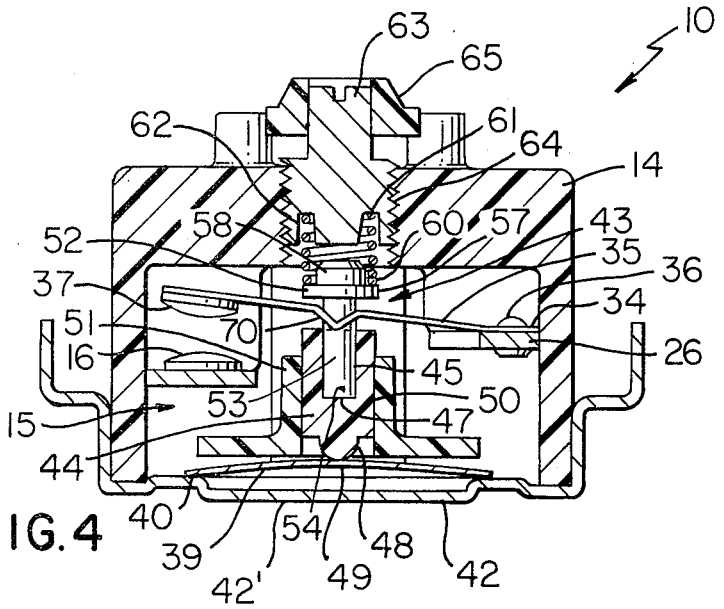
FIG. 4 is a view similar to FIG. 3 and illustrates the contacts of the thermostat construction in the open condition thereof.

Referring now to FIGS. 1–6, the improved thermostat construction of this invention is generally indicated by the reference numeral 10 and is illustrated schematically in FIG. 1 as being utilized in an electrical control system that is generally indicated by the reference numeral 11, the electrical control system 11 comprising a pair of power source leads L1 and L2 adapted to energize an electrical heater means 12 when the thermostat construction 10 is disposed in the condition illustrated in FIG. 3 in a manner hereinafter set forth and for disconnecting the power source lead L2 from the electrical heater means 12 when the thermostat construction 10 is disposed in the condition illustrated in FIG. 4 in a manner hereinafter described.

The thermostat construction 10 comprises a generally cube-shaped housing means 14 having a chamber 15 therein containing a fixed contact 16 interconnected to a terminal means 18 adapted to be interconnected to the power source lead L2 while another terminal means 19 is adapted to be interconnected to one side 22 of the electrical heater means 12, the other side 23 of the heater means 12 being interconnected to the power source lead L1.

Figure 5:
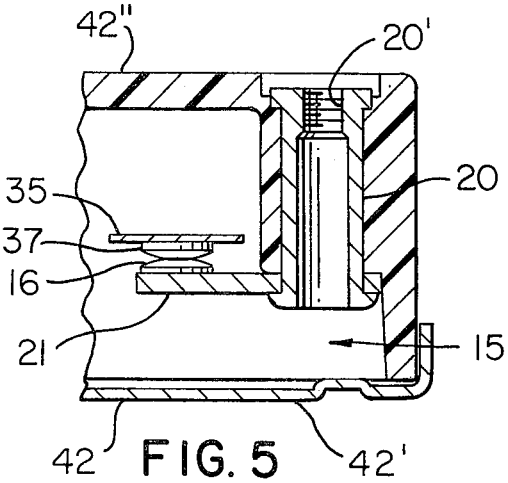
FIG. 5 is a fragmentary, cross-sectional view taken on line 5—5 of FIG. 3.

The terminal means 18 for the fixed contact 16 includes a conductive insert 20, FIG. 5, carried by the housing means 14 and interconnected to a relatively rigid blade 21 disposed in the chamber 15 and carrying the fixed contact 16, the insert 20 having a threaded opening 20' therein to receive a threaded fastening member 20'' of the terminal means 18 to electrically attach the power source lead L2 thereto.

Figure 6:
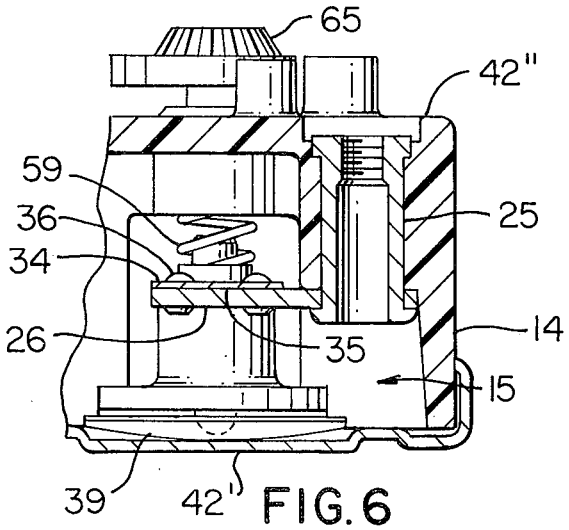
FIG. 6 is a fragmentary cross-sectional view taken on line 6—6 of FIG. 3.
Figure 7:
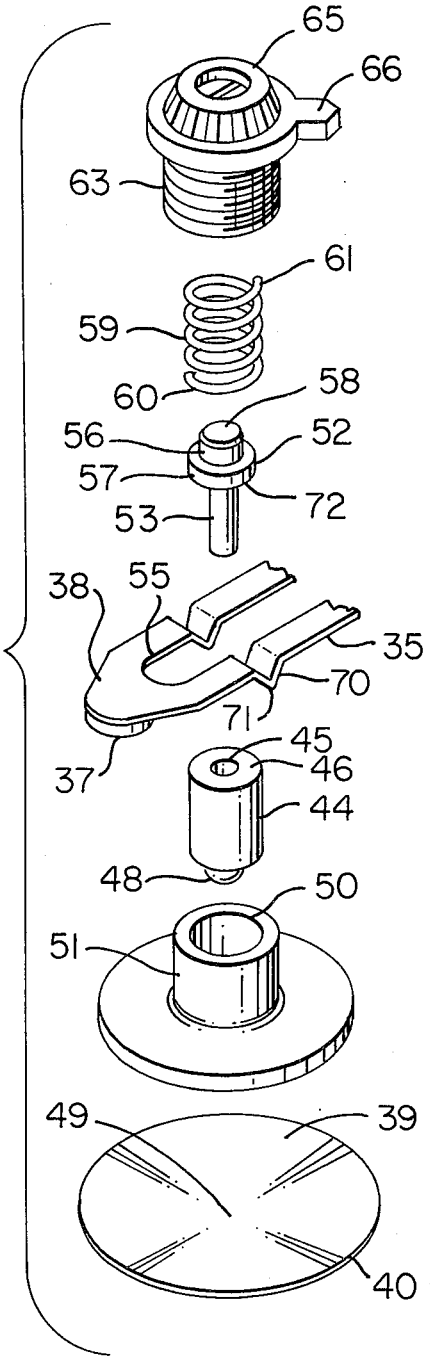
FIG. 7 is an exploded perspective view of the various temperature setting parts of the thermostat construction of FIG. 1.

The other terminal means 19 of the housing means 14 includes a like conductive insert 25, FIG. 6, interconnected to a relatively rigid blade 26 disposed inside the chamber 15 of the housing means and being electrically interconnected to the right-hand end 34 of a conductive switch blade 35 that is fastened thereto by suitable rivet means 36. The switch blade 35 carries contact means 37 on the left-hand free end 38 thereof with the contact means 37 being cooperable wtih the fixed contact 16 in the manner illustrated in FIGS. 3 and 4. However, the natural bias of the spring blade 35 is to move the blade 35 downwardly in the manner illustrated in FIG. 3 to normally place the contact means 37 into good electrical contact with the fixed contact 16 as illustrated.

A bimetallic snap disc of substantially circular configuration 39 is carried by the housing means 14 and has its outer periphery 40 received within a recess 41 formed in the housing means 14 and being held in the recess 41 by a cover member 42 detachably carried by the housing means 14 and closing the chamber 15 thereof as illustrated, the cover member 42 thereby defining a generally square shaped rear face 42' of the housing means 14.

A plunger means 43 of the thermostat 10 comprises a first plunger part 44 having an opening 45 interrupting one flat end 46 thereof to terminate within the part 44 at an end wall 47. The other end 48 of the plunger part 44 is formed with a hemispherical configuration and is adapted to engage against the central part 49 of the snap disc 39 as illustrated.

The plunger part 44 is disposed within a guide opening 50 passing through a guide part 51 secured in the chamber 15 of the housing means 14 in any suitable manner to locate and guide the axial up and down movement of the plunger means 43 between the positions illustrated in FIGS. 3 and 4.

The plunger means 43 has another plunger part 52 that is substantially rivet-shaped so as to have a stem 53 thereof received wtihin the opening 45 of the first plunger part 44 and have its free end 54 bottom out against the end wall 47 at the end of the opening 45 of the plunger part 44 as illustrated in FIGS. 3 and 4. The stem 53 of the plunger part 52 passes loosely through an opening 55 formed centrally through the switch blade 35 as illustrated in the drawings so that the stem 53 does not engage the blade 35 but permits axial movement therebetween.

However, the rivet-like part 52 of the plunger means 43 has a hat-shaped head 56 defined by a first disc-like part 57 adjacent the stem 52 and a smaller disc-like part 58 on top of the disc-like part 57 to act as a spring locating means. For example, a compression spring 59 is carried by the housing means 14 and has one end 60 telescopically disposed over the disc part 58 to rest against the lower disc part 57 as illustrated in FIG. 4 and has another end 61 received within an annular recess 62 of a threaded adjusting member 63 threadedly disposed in a threaded bore 64 formed generally medially of the generally square shaped front face 42'' in the housing means 14 and leading from the exterior thereof to the chamber 15 as illustrated.

The adjusting member 63 has a knob construction 65 secured thereto or formed integrally therewith, as desired, whereby rotation of the knob 65 varies the threaded relation of the threaded member 63 within the housing means 14 and, thus, the force of the compression spring 59 urging the plunger means 43 into engagement with the central part 49 of the snap disc 39. If desired, the knob 65 can have a suitable pointer means 66 extending therefrom to be movable adjacent a scale 67 on the front face 42'' of the housing means 14 as illustrated in FIG. 1 to indicate the temperature setting position of the knob 65 and, thus, the temperature setting of the temperature setting means for the thermostat construction 10. If desired, outwardly extending stops or abutments 68 and 69 can be provided on the housing means 14 to limit rotational movement of the knob 65 to the right and left as illustrated in FIG. 1 as the pointer part 66 of the knob 65 will abut against the stops 68 and 69 when at the opposed limits of its temperature setting positions.

Thus, by varying the threaded relation of the threaded member 63 with the housing 14, the force of the compression spring 59 urging the plunger means 43 into engagement with the central part 49 of the snap disc 39 varies the temperature required for the snap disc 39 to snap from the condition illustrated in FIG. 3 to the condition illustrated in FIG. 4 upon the principles fully set forth in the Spencer, U.S. Pat. No. 2,239,540, whereby the theory and operation of the change in the spring force being imposed on the snap disc 39 to change the temperature required to snap the disc 39 over center in either direction need not be further described.

The switch blade 35 is provided with V-shaped, bent projections 70 on both sides of the opening 55 passing therethrough so that the apex portions 71 of the V-shaped projections 70 are adapted to be engaged by the annular shoulder or wall 46 of the plunger part 44 as the plunger part 44 is being moved upwardly from the position illustrated in FIG. 3 to the position illustrated in FIG. 4 whereby the take-up of the lost motion provided between the annular shoulder 46 and the projections 70 of the blade 35 before the plunger part 44 engages the blade 35 causes the plunger part 44 to abruptly engage the switch blade 35 and move the same upwardly from the position illustrated in FIG. 3 to the position illustrated in FIG. 4 as the snap disc 39 is snapping over center so that any contact weld that might exist between the movable contact 37 and the fixed contact 16 will be broken by such lost motion take-up movement of the plunger part 44.

The snap distance of the snap disc 39 is so constructed and arranged that when the disc 39 is fully snapped over center in the manner illustrated in FIG. 4, the plunger part 44 will hold the movable contact 37 out of contact with the fixed contact 16 in opposition to the force of the normal bias of the spring blade 35 tending to return the movable contact 37 to its down position as illustrated in FIG. 3. However, when the snap disc 37 subsequently snaps back over center from the position illustrated in FIG. 4 to the position illustrated in FIG. 3, the plunger means 43 will follow such movement of the disc 39 because of the downward force of the compression spring 59. Thus, the plunger part 52 will cause the blade 35 to move downwardly until the movable contact 37 is again placed in contact with the fixed contact 16. Such movement of the blade 35 takes place with substantially a snap motion because the compression spring 59 causes the plunger part 52 to follow the snap movement of the disc 39.

Thus, it can be seen that in the operation of the electrical control system 11, when the temperature sensing condition of the snap disc 39 causes the snap disc 39 to be in the position illustrated in FIG. 3, the heating element 12 is being placed across the power source leads L1 and L2 and is, thus, being operated by the thermostat 10. However, when the temperature being sensed by the snap disc 39 changes in such a manner that the same reaches the temperature for which the control knob 65 has been set, the snap disc 39 snaps over center and through the plunger means 44 in the manner previously described snaps the switch blade 35 from the position illustrated in FIG. 3 to the position illustrated in FIG. 4 whereby the heater means 12 is effectively disconnected from the power source lead L2. Conversely, when the temperature being sensed by the snap disc 39 returns to the condition that will cause the snap disc 39 to snap back to the position illustrated in FIG. 3, the snap disc 39 snaps back over center from the position illustrated in FIG. 4 to the position illustrated in FIG. 3 to again interconnect the power source lead L2 back to the heater means 12.

Therefore, it can be seen that the thermostat construction 10 is readily adapted to control a switching operation by the plunger means 43 that serves the dual purpose of setting the operating temperature for the thermostat disc 39 as well as providing opposed abutment means 46 and 72 to move the switch blade 35 between its two positions in a lost motion take-up manner to overcome any welding between the movable contact 37 and the fixed contact 16 in the manner as previously set forth.

Further, by having the plunger means 43 pass through the opening 55 in the blade 35, the blade 35 is not utilized in any manner to translate the motion or force of the compression spring 59 to the central part 49 of the snap disc 39 as provided in the aforementioned patents to Spencer, U.S. Pat. No. 2,239,540, and Manecke, U.S. Pat. No. 3,870,229, and all of the parts 44, 52, 63 and 65 for the temperature setting means of the thermostat 10 are in direct alignment with each other and with the snap disc 39 to provide for accurate temperature setting control for the snap disc 39.

Also, it can be seen that all of the parts 44, 52, 63 and 65 for the temperature setting means of the thermostat 10 pass substantially centrally through the cube-shaped housing means 14 as the snap disc 39 is disposed generally medially of the rear face 42' inside the chamber 15 while the knob 65 of the temperature setting means of the thermostat 10 is disposed generally medially of the front face 42''. Further, the terminal means 18 and 19 are disposed in aligned relation adjacent the lower edge of the generally square shaped front face 42'' of the cube-shaped housing means 14.

In this manner, a relatively compact thermostat construction 10 is provided which is adapted to control the temperature of the heating means 12 in the manner previously described depending upon the setting of the control knob 65 for the reasons previously set forth.

Therefore, it can be seen that this invention not only provides an improved thermostat construction having improved housing means therefor, but also this invention provides a method of making such a thermostat construction or the like.

While the form and method of this invention now preferred have been disclosed as required by the Patent Statute, it is to be understood that other forms and method steps may be utilized and still come within the scope of the appended claims.

What is claimed is:

1. In a thermostat contruction having a first contact and a blade-carried second contact supported in a housing means and having a bimetallic snap disc carried by said housing means for controlling movement of said second contact relative to said first contact in response to snapped temperature sensing conditions of said disc together with temperature setting means carried by said housing means for selecting the temperature of operation of said disc for moving said second contact out of contact with said first contact, the improvement wherein said housing means is generally cube-like in configuration and thereby small and compact.

2. In a thermostat construction as set forth in claim 1, said cube-like housing means having a generally square front face, said temperature setting means being generally medially disposed adjacent said front face of said housing means.

3. In a thermostat construction as set forth in claim 2, said housing means having two terminal means on said front face thereof and being respectively electrically interconnected to said first and second contacts in said housing means.

4. In a thermostat construction as set forth in claim 3, said front face of said housing means having four side edges, said two terminal means being disposed in aligned relation adjacent one of said side edges.

5. In a thermostat construction as set forth in claim 4, said housing means having a generally square rear face, said disc being generally medially disposed adjacent said rear face inside said housing means.

6. In a method of making a thermostat construction having a first contact and a blade-carried second contact supported in a housing means and having a bimetallic snap disc carried by said housing means for controlling movement of said second contact relative to said first contact in response to snapped temperature sensing conditions of said disc together with temperature setting means carried by said housing means for selecting the temperature of operation of said disc for moving said second contact out of contact with said first contact, the improvement comprising the step of forming said housing means to be generally cube-like in configuration and thereby small and compact.

7. In a method of making thermostat contruction as set forth in claim 6 wherein said step of forming said housing means causes said cube-like housing to have a generally square front face, and disposing said temperature setting means generally medially adjacent said front face of said housing means.

8. In a method of making a thermostat construction as set forth in claim 7, the additional step of forming two terminal means on said front face of said housing means to be respectively electrically interconnected to said first and second contacts in said housing means.

9. In a method of making a thermostat construction as set forth in claim 8 wherein said step of forming said housing means causes said front face of said housing means to have four side edges, said step of disposing said two terminal means comprising the step of disposing said two terminal means so as to be in aligned relation adjacent one of said side edges.

10. In a thermostat construction as set forth in claim 9 wherein said step of forming said housing means causes said housing means to have a generally square rear face, and disposing said disc so as to be generally medially disposed adjacent said rear face inside said housing means.

* * * * *